US006997994B2

(12) United States Patent
Sudo

(10) Patent No.: US 6,997,994 B2
(45) Date of Patent: Feb. 14, 2006

(54) NI BASED ALLOY, METHOD FOR PRODUCING THE SAME, AND FORGING DIE

(75) Inventor: Koji Sudo, Tochigi-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 183 days.

(21) Appl. No.: 10/245,220

(22) Filed: Sep. 17, 2002

(65) Prior Publication Data

US 2003/0051777 A1 Mar. 20, 2003

(30) Foreign Application Priority Data

Sep. 18, 2001 (JP) ..... 2001-284046
Sep. 18, 2001 (JP) ..... 2001-284055

(51) Int. Cl.
*C22C 19/05* (2006.01)

(52) U.S. Cl. ..... 148/410; 420/448

(58) Field of Classification Search ..... 148/410, 148/428; 420/448

See application file for complete search history.

(56) References Cited

U.S. PATENT DOCUMENTS

| | | | | |
|---|---|---|---|---|
| 3,660,177 A | | 5/1972 | Brown et al. | 18/11.5 R |
| 3,871,928 A | * | 3/1975 | Smith et al. | 148/607 |
| 5,725,692 A | * | 3/1998 | DeLuca et al. | 148/410 |
| 6,730,264 B1 | * | 5/2004 | Cao | 420/448 |

FOREIGN PATENT DOCUMENTS

| | | |
|---|---|---|
| EP | 0 957 183 A1 | 11/1999 |
| JP | 60221542 A | 11/1985 |
| JP | 06240427 A | 8/1994 |
| JP | 09 184053 | 7/1997 |
| JP | 10 237609 | 9/1998 |
| JP | 10 265878 | 10/1998 |

OTHER PUBLICATIONS

"Precipitation in Alloy 718: a combined AEM and APFIM investigation," Chemical Abstracts vol. 117, No. 2, abstract No. 12542, p. 341, paragraph 3, p. 342, paragraph 1; Figure 9, Burke, et al. *Super alloys 718, 625 and Various Derivatives*, The Minerals, Metals & Materials Society (1991) (XP009002251).

* cited by examiner

*Primary Examiner*—George Wyszomierski
(74) *Attorney, Agent, or Firm*—Standley Law Group LLP

(57) ABSTRACT

A solution treatment is firstly performed for a non-heat-treated Ni based alloy having a composition equivalent to that of Inconel 718 (registered trademark). Subsequently, a primary aging treatment is applied by holding the Ni based alloy at 610 to 660° C. for 5 to 10 hours. After that, a secondary aging treatment is performed by holding the Ni based alloy at 710 to 760° C. for 5 to 10 hours. There are 700 or more precipitates per $\mu m^2$, in which each precipitate has a longer diameter of not less than 0.5 nm, in a metal microstructure of the Ni based alloy. Some of the precipitates are large precipitates having average diameters of 25 nm to 1 $\mu m$. There are 10 or more large precipitates per $\mu m^2$. A forging die is produced with the Ni based alloy.

12 Claims, 5 Drawing Sheets

$$\text{LONGER DIAMETER} = \frac{x}{\text{MEASUREMENT MAGNIFICATION}}$$

$$\text{SHORTER DIAMETER} = \frac{y}{\text{MEASUREMENT MAGNIFICATION}}$$

$$\text{LONGER DIAMETER} = \frac{x}{\text{MEASUREMENT MAGNIFICATION}}$$

$$\text{SHORTER DIAMETER} = \frac{y}{\text{MEASUREMENT MAGNIFICATION}}$$

NI BASED ALLOY, METHOD FOR PRODUCING THE SAME, AND FORGING DIE

BACKGROUND OF THE INVENTION

1. Field of the Invention

The present invention relates to an Ni based alloy having excellent strength, hardness, and toughness, a method for producing the Ni based alloy, and a forging die of the Ni based alloy.

2. Description of the Related Art

FIG. 5 shows a gear 1 to be used, for example, for an automobile transmission. The gear 1 has a large diameter section 2 and a small diameter section 3 which has a diameter smaller than that of the large diameter section 2. Outer teeth 4 are provided on a side circumferential wall of the small diameter section 3.

The gear 1 is produced, for example, by hot forging. At first, an unillustrated ring-shaped workpiece made of SCR420H, SCM420H, HNCM (according to JIS (Japanese Industrial Standard)) or the like, is heated to about 1100 to 1200° C. After that, the ring-shaped workpiece is arranged in a die. Subsequently, the workpiece is pressed by a punch or the like, and the workpiece is plastically deformed to have a shape corresponding to the gear 1. During this process, the outer teeth 4 are formed on the side circumferential wall of the ring-shaped workpiece by a teeth-forming section provided on the die. In the hot forging, the workpiece is softened by recrystallization. Therefore, no work hardening is caused. Accordingly, the ductility of the workpiece is increased, and hence the workpiece can be machined with ease.

Die steel for hot working including high speed tool steel and maraging stainless steel is widely used as a raw material of the die for hot forging, because the die steel for hot working is inexpensive and can be easily formed to various shapes.

When the gear 1 is produced by hot forging as described above, the temperature of the die is increased, because the heat is transmitted from the ring-shaped workpiece to the die. The temperature of the die is about 725° C., and instantaneously about 1100° C.

For this reason, when the hot forging is repeated about 3000 times, the die is abraded and chipped. If such a die is used, defective gears each having a size deviating from a predetermined standard are formed. Therefore, the forging machine is stopped, and then the die is replaced with a new die.

In this procedure, since the forging operation is interrupted, the production efficiency of the gear 1 is lowered. Further, the equipment cost for performing the hot forging is expensive, because the die is frequently replaced.

It is difficult to improve the production efficiency of forged products, because an ordinary hot forging die has a short service life. Therefore, the machining cost is expensive.

SUMMARY OF THE INVENTION

A principal object of the present invention is to provide an Ni based alloy in which hardness, strength, and toughness are improved because of the presence of precipitates, and which is preferably used as a raw material of a forging die; a method for producing the Ni based alloy; and a forging die of the Ni based alloy.

According to the present invention, there is provided an Ni based alloy containing 50 to 55 wt % Ni, 17 to 21 wt % Cr, 2.8 to 3.3 wt % Mo, 4.75 to 5.5 wt % Ta and Nb in total provided that Ta is not more than 0.1 wt %, 0.65 to 1.15 wt % Ti, 0.2 to 0.8 wt % Al, and Fe and unavoidable impurity as a residue, wherein the Ni based alloy includes not less than 700 precipitates per $\mu m^2$ when observed two-dimensionally with a transmission electron microscope, provided that an electron beam transmission thickness is normalized to 10 nm, and each of the precipitates has a longer diameter of not less than 0.5 nm; and wherein the alloy includes large precipitates having an average diameter of 25 nm to 1 $\mu$m, the average diameter being defined as: (longer diameter+shorter diameter)/2.

The composition of the Ni based alloy is equivalent to the composition of the major component of Inconel 718 (registered trademark). It is noted that the large precipitates as described above are absent in the metal microstructure of the commercially available Ni based alloy having the composition equivalent to that of Inconel 718.

In the Ni based alloy in which the precipitates are contained in the metal microstructure, when thermal stress is generated in the Ni based alloy, or when mechanical stress is applied to the Ni based alloy, the transmission of the thermal stress or the mechanical stress is remarkably suppressed by the presence of the precipitates. Accordingly, the Ni based alloy of the present invention is excellent in strength, hardness, and toughness. In other words, the Ni based alloy of the present invention is a precipitation hardening alloy.

The Ni based alloy according to the present invention may further contain not more than 0.08 wt % Co, not more than 0.01 wt % B, not more than 0.08 wt % Cu, not more than 0.08 wt % C, not more than 0.35 wt % Si, not more than 0.35 wt % Mn, not more than 0.015 wt % P, and not more than 0.015 wt % S.

It is preferable that there are 10 or more large precipitates per $\mu m^2$ in the metal microstructure. If there are less than 10 large precipitates per $\mu m^2$, it is not easy to suppress the transmission of the stress by the large precipitates. Therefore, the respective characteristics of the Ni based alloy are unsatisfactory.

The composition of the precipitates is principally $Ni_3Nb$, i.e., the $\gamma''$ phase. The respective characteristics of the Ni based alloy equivalent to Inconel 718 are improved by the $\gamma''$ phase. $Ni_3(Al, Ti)$, i.e., the $\gamma'$ phase, may also comprise some of the precipitates.

It is preferable that a crystal grain size of base metal in the metal microstructure is not less than No. 8 according to ASTM (American Society for Testing and Materials).

In ASTM, the larger the numeral of the crystal grain size is, the smaller the average cross-sectional area of the crystal grain is. In the Ni based alloy of the present invention, it is preferable that the average cross-sectional area of the crystal grain of the base metal in the metal microstructure is small. On this condition, it is more difficult for the stress to cause transmission through the metal microstructure. Consequently, the respective characteristics are further improved. Specifically, in many cases, Rockwell C scale hardness is above 40 in the Ni based alloy.

According to another aspect of the present invention, there is provided a method of producing an Ni based alloy, wherein the Ni based alloy includes not less than 700 precipitates per $\mu m^2$ when observed two-dimensionally with a transmission electron microscope having an electron beam transmission thickness normalized to 10 nm, wherein each of the first precipitates has a longer diameter of not less than 0.5 nm, and wherein the alloy includes a number of large precipitates having an average diameter of 25 nm to 1 μm, the average diameter defined as: (longer diameter+shorter diameter)/2. A method for producing the Ni based alloy comprises:

applying a solution treatment to a non-heat-treated Ni based alloy containing 50 to 55 wt % Ni, 17 to 21 wt % Cr, 2.8 to 3.3 wt % Mo, 4.75 to 5.5 wt % Ta and Nb in total provided that Ta is not more than 0.1 wt %, 0.65 to 1.15 wt % Ti, 0.2 to 0.8 wt % Al, and Fe and unavoidable impurity as a residue;

performing a primary aging treatment at a first temperature after the solution treatment; and performing a secondary aging treatment at a second temperature higher than a first temperature.

In this production method, the non-heat-treated Ni based alloy, which has the composition equivalent to the composition of the major component of Inconel 718 (registered trademark), is used as a raw material. The primary aging treatment is performed at the low temperature after the solution treatment, and the secondary aging treatment is performed at the high temperature. Usually, as for the aging treatments after the solution treatment for the non-heat-treated Ni based alloy having the composition equivalent to that of Inconel 718, the primary aging treatment is performed at a high temperature, and the secondary aging treatment is performed at a low temperature. However, in the production method of the present invention, the primary aging treatment is performed at the low temperature, and the secondary aging treatment is performed at the high temperature.

When the aging treatments are performed in the order as described above, it is possible to obtain the Ni based alloy in which there are 700 or more precipitates having the longer diameters of not less than 0.5 nm per $\mu m^2$ in the metal microstructure, and some of the precipitates are the large precipitates of 25 nm to 1 μm. The large precipitates as described above do not exist in the metal microstructure of the commercially available Ni based alloy having the composition equivalent to that of Inconel 718.

The non-heat-treated Ni based alloy may further contain not more than 0.08 wt % Co, not more than 0.01 wt % B, not more than 0.08 wt % Cu, not more than 0.08 wt % C, not more than 0.35 wt % Si, not more than 0.35 wt % Mn, not more than 0.015 wt % P, and not more than 0.015 wt % S.

In order to obtain the large precipitates not less than $10/\mu m^2$ in the metal microstructure, it is preferable that the primary aging treatment is performed at 610 to 660° C., and the secondary aging treatment is performed at 710 to 760 ° C.

When the respective aging treatments are performed within the temperature ranges as described above, the composition of the precipitates is principally $Ni_3Nb$, i.e., the γ" phase. The respective characteristics of the Ni based alloy equivalent to Inconel 718 are improved by the γ" phase. Of course, $Ni_3(Al,Ti)$, i.e., the γ' phase, may may also comprise some of the precipitates.

In order to precipitate the precipitates with the average diameters and the densities to obtain the desired respective characteristics of the Ni based alloy, it is preferable that each holding time in the primary aging treatment and in the secondary aging treatment is 5 to 10 hours.

It is preferable that a crystal grain size of base metal in the non-heat-treated Ni based alloy is not less than No. 8 according to ASTM.

According to still another aspect of the present invention, there is provided a forging die made of an Ni based alloy, the Ni based alloy containing 50 to 55 wt % Ni, 17 to 21 wt % Cr, 2.8 to 3.3 wt % Mo, 4.75 to 5.5 wt % Ta and Nb in total provided that Ta is not more than 0.1 wt %, 0.65 to 1.15 wt % Ti, 0.2 to 0.8 wt % Al, and Fe and unavoidable impurity as a residue, wherein the Ni based alloy includes not less than 700 precipitates per $\mu m^2$ when observed two-dimensionally with a transmission electron microscope, provided that an electron beam transmission thickness is normalized to 10 nm, and each of the precipitates has a longer diameter of not less than 0.5 nm; and wherein the alloy includes a number of large precipitates having an average diameter of 25 nm to 1 μm, the average diameter being defined as: (longer diameter+shorter diameter)/2.

The forging die of the present invention is made from the Ni based alloy described above. In other words, the die is excellent in strength, hardness, and toughness. Accordingly, even when the forging is repeatedly performed, the die is hardly abraded and chipped. Therefore, the frequency to replace the die is remarkably decreased. Accordingly, the cost required for the die is reduced. Consequently, it is possible to reduce the equipment cost for performing the forging. Further, the frequency to interrupt the forging operation is also decreased. Therefore, the production efficiency of the forged product is also improved.

The Ni based alloy of the forging die according to the present invention may further contain not more than 0.08 wt % Co, not more than 0.01 wt % B, not more than 0.08 wt % Cu, not more than 0.08 wt % C, not more than 0.35 wt % Si, not more than 0.35 wt % Mn, not more than 0.015 wt % P, and not more than 0.015 wt % S.

In view of the fact that stress transmission can be reliably suppressed as described above, it is preferable that there are 10 or more large precipitates per $\mu m^2$.

The reason why the respective characteristics of the die are excellent is that the γ" phase is contained in the precipitates. Of course, the γ' phase may also be contained in the precipitates.

It is preferable that a crystal grain size of base metal in the metal microstructure is not less than No. 8 according to ASTM in the Ni based alloy of the die. On this condition, the respective characteristics of the die are more excellent. For example, Rockwell C scale hardness of the die is above 40.

The die may be used for hot forging. In this case, since new precipitates are precipitated in the metal microstructure of the Ni based alloy, the respective good characteristics of the die are maintained. Accordingly, the service life of the die is prolonged.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

At first, explanation will be made for an Ni based alloy according to an embodiment of the present invention, and a forging die made from the Ni based alloy.

Figure 1:
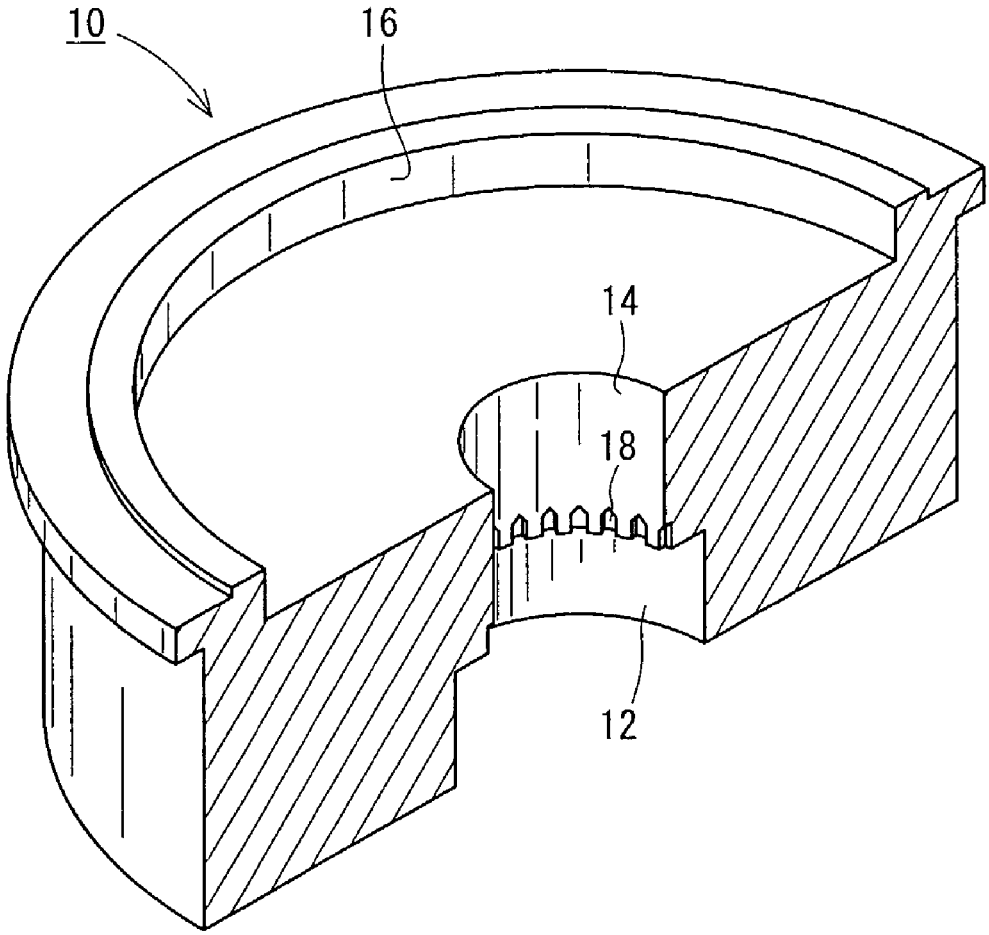
FIG. 1 is a schematic perspective view with a vertical cross section illustrating a forging die according to an embodiment of the present invention.
Figure 2:
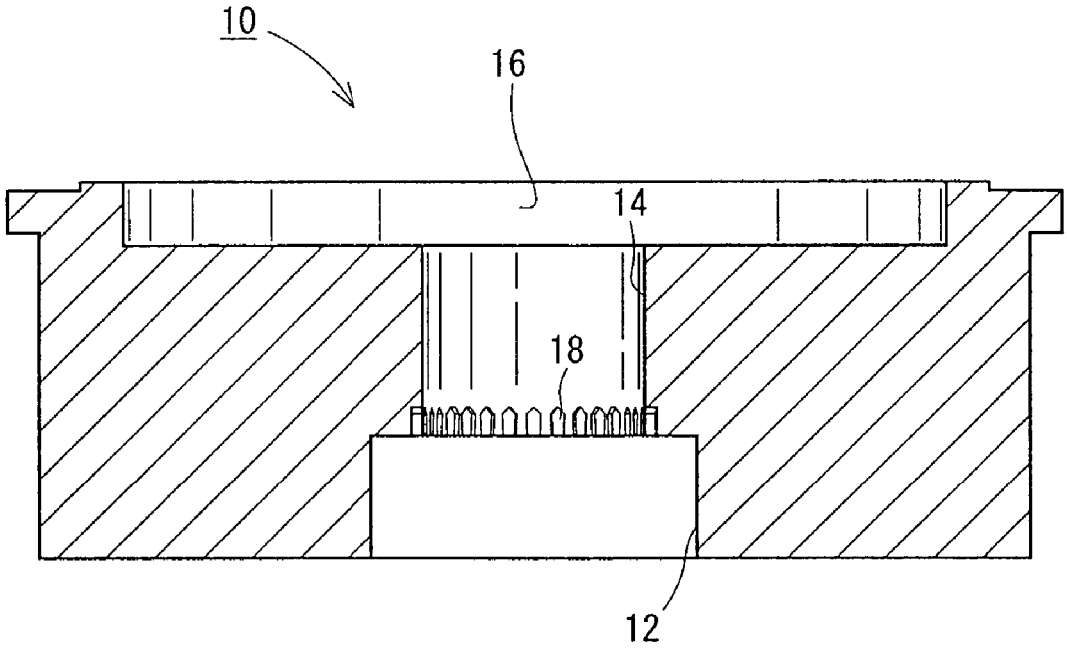
FIG. 2 is a plan view illustrating the forging die shown in FIG. 1.
Figure 5:
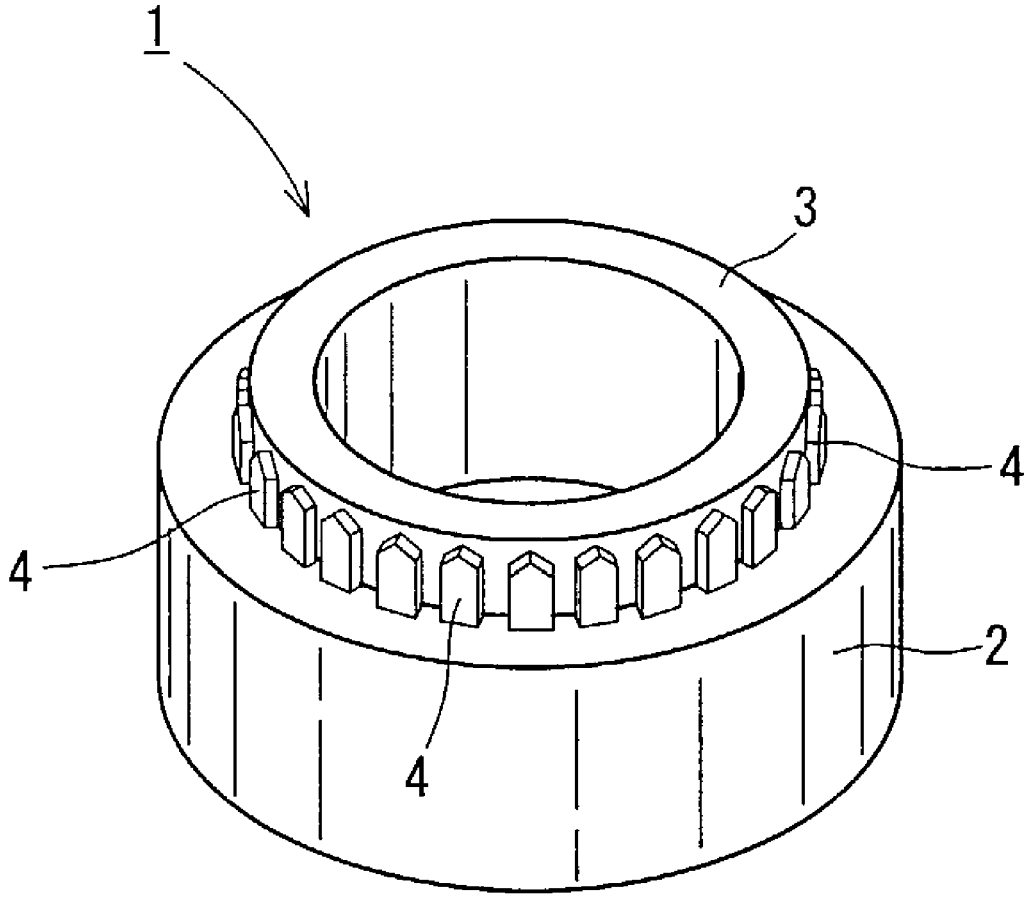
FIG. 5 is a schematic perspective view illustrating a whole gear having outer teeth on a small diameter section.

FIG. 1 is a schematic perspective view with a vertical cross section illustrating a forging die 10, and FIG. 2 shows a plan view illustrating the forging die 10 shown in FIG. 1. The die 10, which is substantially cylindrical, is a die for forming a gear 1 shown in FIG. 5. The die 10 is preferably used for hot forging.

As shown in FIGS. 1 and 2, the die 10 has a large central through-hole 12 which has a large diameter and is open at the lower end surface of the die 10, and a small through-hole 14 which has a small diameter as compared with the large through-hole 12 such that the large through-hole 12 vertically communicates with the small through-hole 14. A cylindrical recess 16 for attaching the die 10 to an unillustrated forging machine is formed on the upper end surface of the die 10.

Especially, a plurality of teeth-forming grooves 18, which are separated from each other at equal intervals, are provided at the lower end of the inner circumferential wall of the small through-hole 14. Outer teeth 4 of the gear 1 (see FIG. 5) are formed such that the material of the ring-shaped workpiece flows into the teeth-forming grooves 18 (see FIGS. 1 and 2).

The die 10 is made from an Ni based alloy having a composition equivalent to that of Inconel 718. The Ni based alloy contains 50 to 55 wt % Ni, 17 to 21 wt % Cr, 2.8 to 3.3 wt % Mo, 4.75 to 5.5 wt % Ta and Nb in total provided that Ta is not more than 0.1 wt %, 0.65 to 1.15 wt % Ti, 0.2 to 0.8 wt % Al, not more than 0.08 wt % Co, not more than 0.01 wt % B, not more than 0.08 wt % Cu, not more than 0.08 wt % C, not more than 0.35 wt % Si, not more than 0.35 wt % Mn, not more than 0.015 wt % P, and not more than 0.015 wt % S, and Fe and unavoidable impurity as a residue. According to a result of observation with an electron microscope or the like, precipitates which are dispersed in a base metal exist in the metal microstructure of the Ni based alloy.

Especially, the crystal grain size of the base metal is No. 8 as prescribed by ASTM. In other words, an average cross-sectional area of the crystal grain is about 0.00049 $mm^2$.

On the other hand, as for the precipitates in the embodiment of the present invention, there are about 1100 precipitates having longer diameters of not less than 0.5 nm per $\mu m^2$ (square micrometer) in metal microstructure. This value is slightly small as compared with an Ni based alloy equivalent to Inconel 718 as a commercially available product in which there are about 2100 precipitates per $\mu m^2$.

The rate of the precipitates is determined from a result of observation with a transmission electron microscope. The rate is calculated from a density of precipitates in the metal microstructure appeared in a visual field as a two-dimensional plane when a sample of the Ni based alloy is observed with the transmission electron microscope.

The density of the precipitates varies depending on the thickness of a sample for the following reason. All of the precipitates, which are located at mutually different heights in the thickness direction of the sample (direction of transmission of the electron beam), appear in the visual field. For example, when the thickness of the sample is doubled, the density of precipitates is also doubled.

Accordingly, in the embodiment of the present invention, the density is calculated by normalizing the sample thickness (electron beam transmission thickness) to 10 nm. For example, when a sample thickness is 15 nm, the rate of precipitates is calculated by dividing the density of precipitates in the metal microstructure appeared in the visual field of the transmission electron microscope by 1.5. Similarly, when the electron beam transmission thickness is 20 nm, the density of precipitates in the metal microstructure may be divided by 2.

Figure 3:
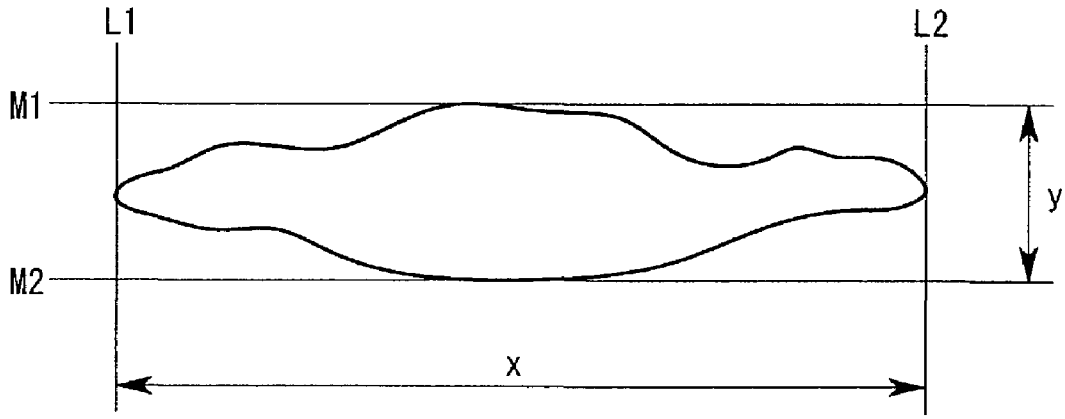
FIG. 3 explains the definition of the longer diameter and the shorter diameter of a precipitate (large precipitate)

As shown in FIG. 3, a longer diameter referred to herein is defined as the value obtained by dividing the spacing distance x by the measurement magnification, wherein the spacing distance x is given as the maximum distance obtained when the both ends of the precipitate in the longitudinal direction photographed by the transmission electron microscope (TEM) are interposed between two parallel lines L1, L2. On the other hand, y in FIG. 3 is the spacing distance which is given as the maximum distance obtained when the precipitate is interposed between parallel lines M1, M2 perpendicular to the parallel lines L1, L2. The value, which is obtained by dividing y by the measurement magnification, is a shorter diameter.

Some of the precipitates are large precipitates having average diameters of 25 nm to 1 $\mu m$ as defined by the following expression (1).

$$\text{Average diameter}=(\text{Longer diameter}+\text{Shorter diameter})/2 \quad (1)$$

In this case, there are about 15 large precipitates per $\mu m^2$ in the metal microstructure. Giant precipitates, which have average diameters above 1 $\mu m$, do not contribute to the improvement in respective characteristics of the die so much.

The grain size distribution of the large precipitates is relatively narrow. In other words, the average diameters of the large precipitates are substantially equivalent to one another.

The large precipitates, which have the large average diameters, do not exist at all in the commercially available product made from the Ni based alloy equivalent to Inconel 718. The large precipitates, which do not exist in the metal microstructure of an ordinary Ni based alloy, are contained in the metal microstructure of the Ni based alloy which constitutes the die 10 according to the embodiment of the present invention.

Almost all of the precipitates have the composition of $Ni_3Nb$ ($\gamma''$ phase). The $\gamma'$ phase, which has the composition represented as $Ni_3(Al, Ti)$, may also comprise some of the precipitates.

As described above, the die 10 according to the embodiment of the present invention is made of the Ni based alloy containing, in the metal microstructure, the precipitates which grow greatly as compared with the precipitates in the commercially available product and which are principally the $\gamma''$ phase. In other words, the Ni based alloy is a precipitation hardening alloy, and the alloy is provided with excellent hardness, strength, and toughness. As described above, the rate of the precipitates in the metal microstructure of the Ni based alloy is slightly lower than that of the commercially available product.

The Rockwell C scale hardness (HRC) of the die 10 is high as compared with the die in which a crystal grain size of the base metal grain is less than No. 8 of ASTM, i.e., the die having the large grain size density. Specifically, HRC of the die having the large grain size density is 40 at maximum. In contrast, HRC of the die 10 according to the embodiment of the present invention exceeds 40. The die having the high hardness has good abrasion resistance. Therefore, such a die has a long service life.

Figure 4:
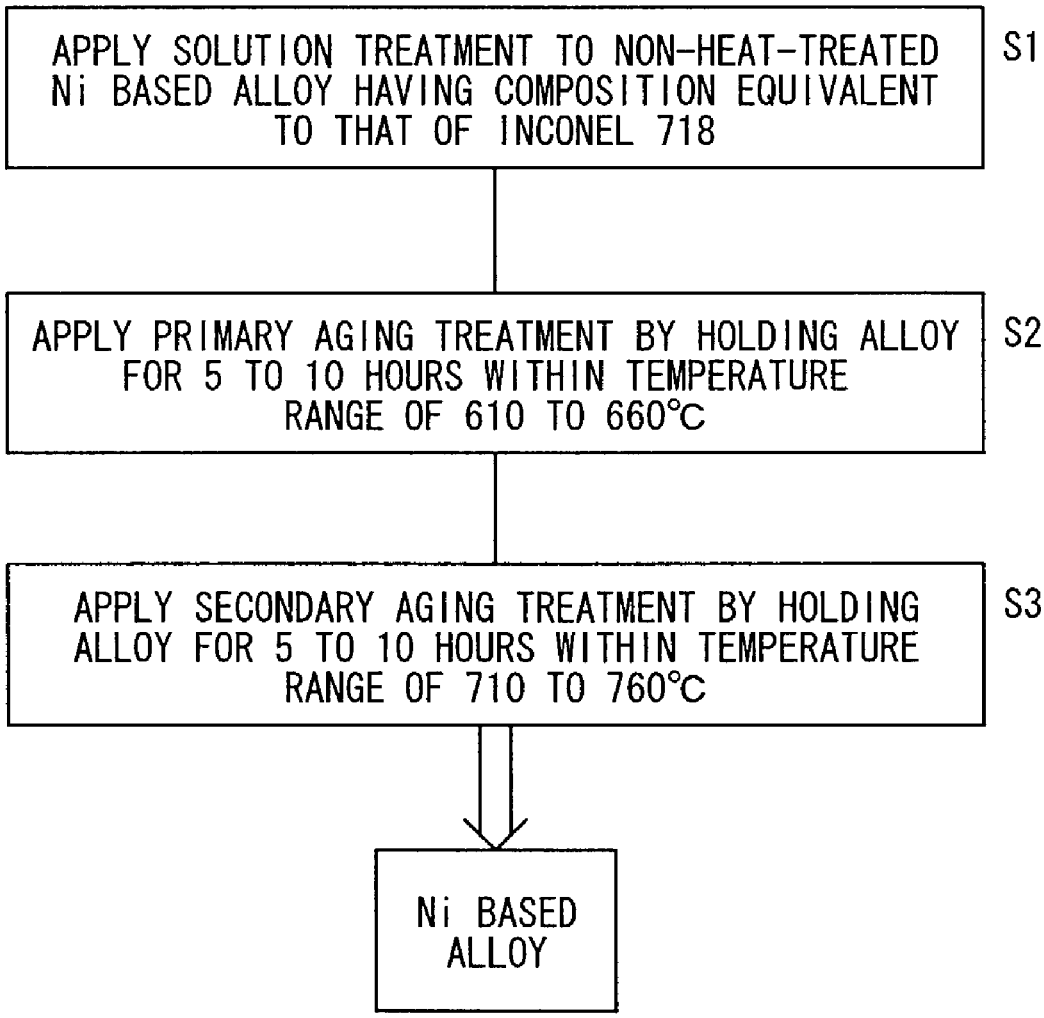
FIG. 4 shows a flow chart of a method for producing an Ni based alloy according to the embodiment of the present invention.

Next, explanation will be made for a method for producing the Ni based alloy according to the embodiment of the present invention. As shown in a flow chart in FIG. 4, the production method comprises a first step S1 of performing a solution treatment for a non-heat-treated Ni based alloy, a second step S2 of performing a primary aging treatment, and a third step S3 of performing a secondary aging treatment.

As for the non-heat-treated Ni based alloy in the embodiment of the present invention, a non-heat-treated Ni based alloy is selected, in which the crystal grain size in ASTM is No. 8 and which has the composition equivalent to that of Inconel 718. The solution treatment is performed in the first step Si for the non-heat-treated Ni based alloy to make a solid solution of solute atoms in the base metal in the alloy. The treatment condition in this procedure may be such that the temperature is about 980 to 1000° C. and the holding time is about 1.5 to 2 hours.

Subsequently, the precipitates are precipitated by the primary aging treatment in the second step S2. The preferred temperature range of the primary aging treatment for the non-heat-treated Ni based alloy having the composition equivalent to that of Inconel 718 is 610 to 660° C. When the temperature range is established as described above, small precipitates (principally the γ" phase) are densely precipitated in the base metal grains and grain boundaries. If the temperature is less than 610° C., the precipitates are sparsely precipitated, because the number of generated nuclei is small. Therefore, it is difficult that the density of the large precipitates in the metal microstructure of the Ni based alloy as the final product is $10/\mu m^2$, and it is not easy to improve the respective characteristics of the Ni based alloy and consequently those of the die 10. On the other hand, if the temperature exceeds 660° C., large nuclei are formed. As a result, the rate of giant precipitates having average diameters exceeding 1 μm is increased. As described above, the giant precipitates do not contribute to the improvement in respective characteristics of the Ni based alloy (die 10) so much. Also in this case, it is not easy to improve the respective characteristics of the Ni based alloy (die 10). The preferred temperature is 630° C.

It is preferable that the holding time in the primary aging treatment is 5 to 10 hours. If the holding time is less than 5 hours, the number of formed nuclei is small. On the other hand, even if the treatment is performed for a period exceeding 10 hours, the respective characteristics of the Ni based alloy are not improved so much. Therefore, such a treatment is uneconomic. Further, the production efficiency of the die 10 as the final product is lowered. The preferred holding time is 8 hours.

Subsequently, the secondary aging treatment is performed in the third step S3. Because of the secondary aging treatment, the precipitates, which have been precipitated in the first aging treatment, are grown to form the large precipitates. Further, new nuclei are formed and grown. Accordingly, it is possible to obtain the Ni based alloy in which the precipitates and the large precipitates as defined above are dispersed in the metal microstructure.

In the secondary aging treatment, the preferred temperature range is 710 to 760° C., and the preferred holding time is 5 to 10 hours. If the temperature is less than 710° C., and/or if the holding time is less than 5 hours, then it is not easy to obtain the large precipitates, because the precipitates are not grown sufficiently. If the temperature exceeds 760° C., and/or if the holding time exceeds 10 hours, then the rate of the giant precipitates having the average diameters exceeding 1 μm is large, because the nuclei are greatly grown. In any case, it is not easy to improve the respective characteristics of the Ni based alloy (die 10). The preferred temperature is 740° C., and the preferred holding time is 8 hours.

The die 10 can be manufactured by performing various machining procedures for the Ni based alloy obtained as described above.

The hot forging by using the forging machine equipped with the die 10 is performed as follows. At first, a ring-shaped workpiece (not shown) made of SCR420H, SCM420H, HNCM, or the like is heated to about 1100 to 1200° C., and then the ring-shaped workpiece is arranged in the large through-hole 12 of the die 10. In this procedure, the ring-shaped workpiece is placed on the bottom of the large through-hole 12.

Subsequently, the ring-shaped workpiece is pressed with a punch (not shown). By pressing, the material of the ring-shaped workpiece flows into the small through-hole 14. Further, a part of the material into the small through-hole 14 flows into the teeth-forming grooves 18. The flow of the material is stopped by an unillustrated pin inserted into the small through-hole 14.

During this process, the heat is transmitted to the die 10 from the ring-shaped workpiece. It is difficult for the die 10 to cause expansion, because the die 10 is surrounded by closely disposed support members in the forging machine. Therefore, the thermal stress is generated in the die 10. However, as described above, the large precipitates, which have the substantially equivalent average diameters, are dispersed in the metal microstructure of the Ni based alloy of the die 10. Further, the precipitates are contained at the appropriate density in the metal microstructure. Therefore, the transmission of thermal stress is remarkably suppressed in the Ni based alloy (die 10) by the precipitates and the large precipitates (principally the γ" phase).

In short, the die 10 is made of the Ni based alloy in which hardness, strength, and toughness are improved because the precipitates are contained in the metal microstructure. Accordingly, the resistance to the thermal stress is high, and the die is scarcely abraded or chipped. Specifically, the hot forging can be repeated about 14,700 times. The die 10 made from the Ni based alloy obtained by the production method according to the embodiment of the present invention has a service life which is about five times as long as that of ordinary dies.

The temperature of the die 10 is raised by the transmission of the heat from the ring-shaped workpiece during the process of the hot forging. As described above, the Ni based alloy of the die 10 is the alloy obtained by performing the primary aging treatment at 610 to 660° C. for 5 to 10 hours and the secondary aging treatment at 710 to 760° C. for 5 to 10 hours. Therefore, the precipitates are incompletely precipitated. Accordingly, additional precipitates are newly precipitated in the metal microstructure of the Ni based alloy during the hot forging. Because of the newly precipitated precipitates, the hardness, the strength, and the toughness of the Ni based alloy are further improved. The service life of the die 10 is remarkably prolonged.

The die 10 has the high abrasion resistance resulting from the fact that HRC exceeds 40. Therefore, the service life is further prolonged.

The die 10 made from the Ni based alloy obtained by the production method according to the embodiment of the present invention is scarcely abraded and chipped. Therefore, the frequency to replace the die 10 is extremely small. Accordingly, it is unnecessary to prepare a large number of spare dies. Therefore, it is possible to reduce the cost required for the forging operation.

The frequency to interrupt the forging operation is also small, because the frequency to replace the die 10 is small. Therefore, the production efficiency of the gear 1 is high.

In the forging process as described above, the material flowing into the small through-hole 14 forms the small diameter section 3, and the material flowing into the teeth-forming grooves 18 forms the outer teeth 4. The large diameter section 2 having the diameter widened up to the diameter of the through-hole 12 is formed in the large through-hole 12. Accordingly, the gear 1 is obtained as a final product.

In the embodiment described above, the die 10 is used for hot forging. Alternatively, the die 10 may be used for cold forging.

In the embodiment described above, the Ni based alloy is applied to the die 10. Alternatively, the Ni based alloy may be used to manufacture a structural element such as a turbine blade or other structural elements.

While the invention has been particularly shown and described with reference to preferred embodiments, it will be understood that variations and modifications can be effected thereto by those skilled in the art without departing from the spirit and scope of the invention as defined by the appended claims.

What is claimed is:

1. An Ni based alloy containing 50 to 55 wt % Ni, 17 to 21 wt % Cr, 2.8 to 3.3 wt % Mo, 4.75 to 5.5 wt % Ta and Nb in total provided that Ta does not comprise more than 0.1 wt %, 0.65 to 1.15 wt % Ti, 0.2 to 0.8 wt % Al, and Fe and unavoidable impurity as a residue;

wherein said Ni based alloy includes 700 to 1,100 precipitates per $\mu m^2$ thereof when observed two-dimensionally with a transmission electron microscope an electron beam transmission thickness normalized to 10 nm, wherein said precipitates are primarily γ" phase precipitates and each of said precipitates has a longer diameter of not less than 0.5 nm; and wherein said precipitate includes a number of large precipitates having an average diameter of between about 25 nm to 1 $\mu m$, said average diameter is defined as: (longer diameter+shorter diameter)/2.

2. The Ni based alloy according to claim 1, further containing not more than 0.08 wt % Co, not more than 0.01 wt % B, not more than 0.08 wt % Cu, not more than 0.08 wt % C, not more than 0.35 wt % Si, not more than 0.35 wt % Mn, not more than 0.015 wt % P, and not more than 0.015 wt % S.

3. The Ni based alloy according to claim 1, wherein there are not less than 10 of said large precipitates per $\mu m^2$ of said alloy.

4. The Ni based alloy according to claim 1, wherein a crystal grain size of base metal in said Ni based alloy is not less than ASTM No. 8.

5. The Ni based alloy according to claim 4, wherein said alloy has a Rockwell C scale hardness of more than 40.

6. A forging die made of an Ni based alloy, said Ni based alloy containing 50 to 55 wt % Ni, 17 to 21 wt % Cr, 2.8 to 3.3 wt % Mo, 4.75 to 5.5 wt % Ta and Nb in total provided that Ta does not comprise more than 0.1 wt %, 0.65 to 1.15 wt % Ti, 0.2 to 0.8 wt % Al, and Fe and unavoidable impurity as a residue;

wherein said Ni based alloy includes 700 to 1,100 precipitates per $\mu m^2$ thereof when observed two-dimensionally with a transmission electron microscope having an electron beam transmission thickness normalized to 10 nm, wherein said precipitates are primarily γ" phase precipitates and each of said precipitates has a longer diameter of not less than 0.5 nm; and wherein said precipitate includes a number of large precipitate having an average diameter of 25 nm to 1 $\mu m$, said average diameter is defined as: (longer diameter+shorter diameter)/2.

7. The forging die according to claim 6, wherein said Ni based alloy further contains not more than 0.08 wt % Co, not more than 0.01 wt % B, not more than 0.08 wt % Cu, not more than 0.08 wt % C, not more than 0.35 wt % Si, not more than 0.35 wt % Mn, not more than 0.015 wt % P, and not more than 0.015 wt % S.

8. The forging die according to claim 6, wherein there are not less than 10 of said large precipitates per $\mu m^2$ of said alloy.

9. The forging die according to claim 6, wherein a crystal grain size of base metal in said Ni based alloy is not less than ASTM No. 8.

10. The forging die according to claim 9, wherein said alloy has a Rockwell C scale hardness is more than 40.

11. The forging die according to claim 6, wherein said die is used for hot forging.

12. The forging die according to claim 6, wherein said die is used in a cold forging process.

* * * * *

UNITED STATES PATENT AND TRADEMARK OFFICE

CERTIFICATE OF CORRECTION

PATENT NO. : 6,997,994 B2
APPLICATION NO. : 10/245220
DATED : February 14, 2006
INVENTOR(S) : Sudo It is certified that error appears in the above-identified patent and that said Letters Patent is hereby corrected as shown below:

In Section (54), please delete "NI BASED ALLOY, METHOD FOR PRODUCING THE SAME, AND FORGING DIE" and insert -- Ni BASED ALLOY, METHOD FOR PRODUCING THE SAME, AND FORGING DIE --.

In column 1, lines 1-3, please delete "NI BASED ALLOY, METHOD FOR PRODUCING THE SAME, AND FORGING DIE" and insert -- Ni BASED ALLOY, METHOD FOR PRODUCING THE SAME, AND FORGING DIE --.

In column 9, lines 33-48, please delete "1. An Ni based alloy containing 50 to 55 wt % Ni, 17 to 21 wt % Cr, 2.8 to 3.3 wt % Mo, 4.75 to 5.5 wt % Ta and Nb in total provided that Ta does not comprise more than 0.1 wt % 0.65 to 1.15 wt % Ti, 0.2 to 0.8 wt % Al, and Fe and unavoidable impurity as a residue;

wherein said Ni based alloy includes 700 to 1,100 precipitates per $\mu m^2$ thereof when observed two-dimensionally with a transmission electron microscope an electron beam transmission thickness normalized to 10 nm, wherein said precipitates are primarily $\gamma''$ phase precipitates and each of said precipitates has a longer diameter of not less than 0.5 nm; and wherein said precipitate includes a number of large precipitates having an average diameter of between about 25 nm to 1 μm, said average diameter is defined as: (longer diameter+shorter diameter)/2." and insert --l. A Ni based alloy containing 50 to 55 wt % Ni, 17 to 21 wt % Cr, 2.8 to 3.3 wt % Mo, 4.75 to 5.5 wt % Ta and Nb in total provided that Ta does not comprise more than 0.1 wt %, 0.65 to 1.15 wt % Ti, 0.2 to 0.8 wt % Al, and Fe and unavoidable impurity as a residue;

wherein said Ni based alloy includes 700 to 1,100 precipitates per $\mu m^2$ thereof when observed two-dimensionally with a transmission electron microscope having an electron beam transmission thickness normalized to 10 nm, wherein said precipitates are primarily $\gamma''$ phase precipitates and each of said precipitates has a longer diameter of not less than 0.5 nm; and wherein said precipitates include a number of large precipitates having an average diameter of between about 25 nm to 1 μm, said average diameter defined as: (longer diameter + shorter diameter)/2. --.

In column 10, line 8-10, please delete "4. The Ni based alloy according to claim 1, wherein a crystal grain size of base metal in said Ni based alloy is not less than ASTM No. 8." and insert -- 4. The Ni based alloy according to claim 1, wherein a crystal grain size of a base metal in said Ni based alloy is not less than ASTM No. 8. --.

UNITED STATES PATENT AND TRADEMARK OFFICE

CERTIFICATE OF CORRECTION

PATENT NO. : 6,997,994 B2
APPLICATION NO. : 10/245220
DATED : February 14, 2006
INVENTOR(S) : Sudo It is certified that error appears in the above-identified patent and that said Letters Patent is hereby corrected as shown below:

In column 10, lines 13-30, please delete "6. A forging die made of an Ni based alloy, said Ni based alloy containing 50 to 55 wt % Ni, 17 to 21 wt % Cr, 2.8 to 3.3 wt % Mo, 4.75 to 5.5 wt % Ta and Nb in total provided that Ta does not comprise more than 0.1 wt %, 0.65 to 1.15 wt % Ti, 0.2 to 0.8 wt % Al, and Fe and unavoidable impurity as a residue;

wherein said Ni based alloy includes 700 to 1,100 precipitates per $\mu m^2$ thereof when observed two-dimensionally with a transmission electron microscope having an electron beam transmission thickness normalized to 10 nm, wherein said precipitates are primarily $\gamma''$ phase precipitates and each of said precipitates has a longer diameter of not less than 0.5 nm; and wherein said precipitate includes a number of large precpitate having an average diameter of 25 nm to 1 μm, said average diameter is defined as: (longer diameter+shorter diameter)/2." and insert -- 6. A forging die made of a Ni based alloy, said Ni based alloy containing 50 to 55 wt % Ni, 17 to 21 wt % Cr, 2.8 to 3.3 wt % Mo, 4.75 to 5.5 wt % Ta and Nb in total provided that Ta does not comprise more than 0.1 wt %, 0.65 to 1.15 wt % Ti, 0.2 to 0.8 wt % Al, and Fe and unavoidable impurity as a residue;

wherein said Ni based alloy includes 700 to 1,100 precipitates per $\mu m^2$ thereof when observed two-dimensionally with a transmission electron microscope having an electron beam transmission thickness normalized to 10 nm, wherein said precipitates are primarily $\gamma''$ phase precipitates and each of said precipitates has a longer diameter of not less than 0.5 nm; and wherein said precipitates include a number of large precipitates having an average diameter of between about 25 nm to 1 μm, said average diameter is defined as: (longer diameter + shorter diameter)/2. --.

In column 10, lines 40-42, please delete "9. The forging die according to claim 6, wherein a crystal grain size of base metal in said Ni based alloy is not less than ASTM No. 8." and insert -- 9. The forging die according to claim 6, wherein a crystal grain size of a base metal in said Ni based alloy is not less than ASTM No. 8.--.

In column 10, lines 43-44, please delete "10. The forging die according to claim 9, wherein said alloy has a Rockwell C scale hardness is more than 40." and insert -- 10. The forging die according to claim 9, wherein said alloy has a Rockwell C scale hardness of more than 40. --.

UNITED STATES PATENT AND TRADEMARK OFFICE

CERTIFICATE OF CORRECTION

PATENT NO. : 6,997,994 B2
APPLICATION NO. : 10/245220
DATED : February 14, 2006
INVENTOR(S) : Sudo It is certified that error appears in the above-identified patent and that said Letters Patent is hereby corrected as shown below:

In column 10, lines 45-46, please delete "11. The forging die according to claim 6, wherein said die is used for hot forging." and insert -- 11. The forging die according to claim 6, wherein said die is used in a hot forging process. --.

Signed and Sealed this

Twenty-seventh Day of February, 2007

JON W. DUDAS
*Director of the United States Patent and Trademark Office*